US006053355A

United States Patent [19]

Rupp et al.

[11] Patent Number: 6,053,355

[45] Date of Patent: Apr. 25, 2000

[54] PAPER-TOWEL DISPENSER

[76] Inventors: Hans Rupp, Hohlstrasse 23, D-55743 Idar-Oberstein; Rüdiger Weiser, Hauptstrasse 94, D-55626 Bundenbach, both of Germany

[21] Appl. No.: 08/693,071

[22] PCT Filed: Feb. 1, 1995

[86] PCT No.: PCT/EP95/00365

§ 371 Date: Dec. 13, 1996

§ 102(e) Date: Dec. 13, 1996

[87] PCT Pub. No.: WO95/20905

PCT Pub. Date: Aug. 10, 1995

[30] Foreign Application Priority Data

Feb. 2, 1994 [DE] Germany ..... 44 03 176

[51] Int. Cl.[7] ..... A47K 10/24

[52] U.S. Cl. ..... 221/45; 225/43

[58] Field of Search ..... 221/45, 33, 30, 221/283; 225/43

[56] References Cited

U.S. PATENT DOCUMENTS 3,128,024 4/1964 Downham ..... 225/43

FOREIGN PATENT DOCUMENTS

483749A1 10/1991 European Pat. Off. .
2922581 1/1979 Germany .

*Primary Examiner*—Kenneth Noland
*Attorney, Agent, or Firm*—K. V. Sidor

[57] ABSTRACT

On a housing (10) which has a mount (20) for a roll (22) of paper, a roller (30) is mounted, by means of a spindle body (32), beneath said mount. A spring (40) is wound in the form of a coil around the spindle body (32) and, in the event of forwards rotation of the roller (30), is subjected to stressing and rotates said roller into a rest position after the paper web (24) has been severed. An end section (42, 48) of the spring (40) is formed by spring coils which always rest against the spindle body (32) in a close-fitting manner, with the result that they act as a directional lock. Between its end sections (42, 48), the spring (40) has a main part (46) comprising spring coils which, in the non-stressed state, enclose the spindle body (32) with radial spacing, only rest against the spindle body (32) in a close-fitting manner after a predetermined forwards rotation of the roller (30), and consequently prevent further rotation of the roller (30). This means that a paper web (24) of predetermined length can be drawn off the roll (22) via the roller (30). The drawn-off paper length can then be severed from the paper web (24) by means of a severing device (50).

4 Claims, 1 Drawing Sheet

PAPER-TOWEL DISPENSER

Figure 1:
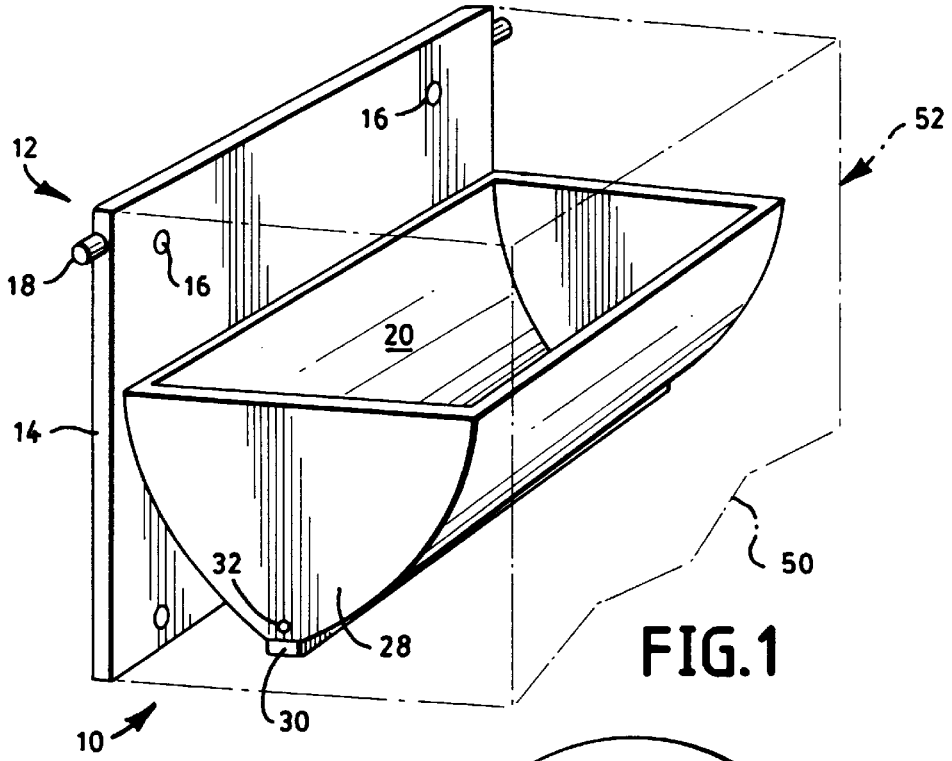

The invention relates to a paper-towel dispenser according to the preamble of Claim 1.

In known paper-towel dispensers of this generic type (DE-A 21 32 756 and DE-A 28 36 709), a roller, which may be made up of a plurality of disks, is fastened on a spindle body which is mounted in lateral walls of a housing in a rotatable manner. Fastened at one end of the spindle body is a lever which is connected to the housing by a spring. The spring may be a tension spring (DE-A 2132756) or a spiral spring (DE-A 2836709) and, in both cases, has the purpose of rotating the roller into a rest position after it has been rotated through a specific angle as a piece of paper is drawn off a roll. The angle of, for example, 720° through which the roller can be rotated is determined by a gear mechanism which is made up of cam disks, levers and further components and also controls lifting movements of a severing device. In one of these paper-towel dispensers (DE-A 28 36 709), one end region of the spindle body has wound around it a plurality of coils of a helical spring which has one spring end fixed to the housing and, as a friction brake, is evidently intended to prevent a really quick rotation of the roller.

The object of the invention in the case of a paper-towel dispenser having a roller which determines the length of the web sections which can be drawn off a roll is to ensure in a simpler manner sufficiently accurate delimitation of the angle of rotation of the roller and restoring of the latter.

The object is achieved according to the invention by the features of Claim 1.

The spring end section formed according to the invention by spring coils resting against the spindle body in a closed-fitting manner can be produced and mounted particularly simply; the spring as a whole is simply pushed onto the spindle body, and there is no need for any further measures in order to make it possible for the spring coils wound around the spindle body in a close-fitting manner at one end section of the spring to act as a directional lock. This means that the spring can only rotate in one direction relative to the spindle body; in the opposite direction, in contrast, friction acts between the close-fitting spring coils and the spindle body such that said spring coils enclose the spindle body in an even more close-fitting manner and consequently prevent relative rotation between the spring and spindle body. The spring is coiled according to the invention such that the directional lock formed by the close-fitting spring coils executes a locking action in the direction of forwards rotation of the roller. Consequently, a forwards rotation of the roller results in the main part of the spring being subjected to stressing, in which case its spring coils come to fit more closely until, finally, they too rest against the spindle body in a close-fitting manner and consequently prevent any further forwards rotation of the roller.

As soon as the paper web which has drawn off around the roller, the latter having been driven by said paper web, has been torn off or cut off, the roller is rotated back by the spring. However, according to the invention, this does not mean that the rest position finally assumed by the roller is precisely predetermined; in contrast, the backwards rotation of the roller has the effect of making the spring coils temporarily widen beyond their original diameter. This applies both to the spring coils of the main part and to the spring coils which normally rest against the spindle body in a close-fitting manner, it then being possible for these to slide on the spindle body during backwards rotation of the roller. Consequently, the backwards rotation of the roller is not terminated abruptly, but smoothly, the spring being subjected only to moderate loading in all of its regions. As a result, there is no need for the spring to be of particularly sturdy dimensions in order for it to have a long service life.

The advantage of the further configuration of the invention described in Claim 2 is that the main part of the spring can widen only to a limited extent during backwards rotation of the roller, that is to say only to the extent where the spring coils rest against the inner side of the roller. This avoids the risk of the spring coils of the main part of the spring being brought into disarray in the event of quick backwards rotation of the roller.

The configuration of the invention described in Claim 3 is particularly advantageous; a modification of this is the subject matter of Claim 4.

Figure 2:
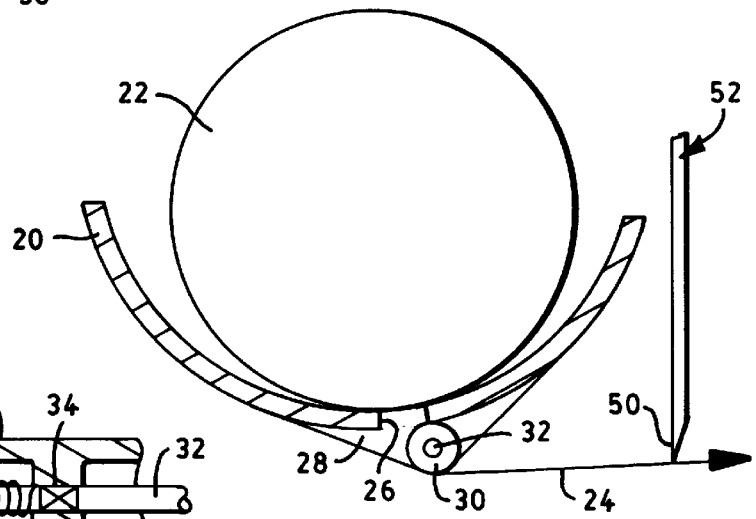
Figure 4:
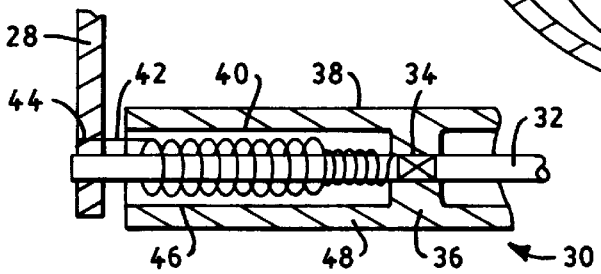
Figure 3:
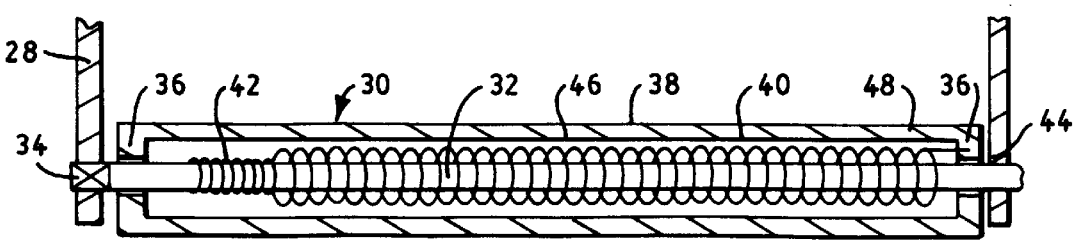

Exemplary embodiments of the invention are described in more detail hereinbelow with reference to schematic drawings, in which:

FIG. 1 shows a perspective view of a paper-towel dispenser according to the invention, FIG. 2 shows an enlarged cross-section through parts of the same paper-towel dispenser, FIG. 3 shows a further-enlarged longitudinal section through parts of the same paper-towel dispenser, and FIG. 4 shows a modification of FIG. 3.

The paper-towel dispenser represented in FIGS. 1 to 3 has a housing 10 with a rear housing part 12 which has a mounting panel 14 with fastening holes 16, for screwing the unit on a wall or the like and hinge pins 18. The mounting panel 14 bears a trough-like mount 20 for a paper roll 22, from which a paper web 24 can be drawn off through a slit 26 in the bottom region of the mount. The mounting panel 14 and mount 20 are preferably injection molded from plastic in one piece. The mount 20 is provided, in particular, for rolls 22 without a winding core. For rolls with a winding core, it is possible to provide a mount which has two bearing journals which engage into the winding core.

In the example represented, the trough-like mount 20 is delimited by two lateral walls 28. Between these, a roller 30 is horizontally mounted, parallel to the mount 20, on a spindle body 32 in a rotatable manner. The spindle body 32 is borne by the two walls 28 and is secured against rotation according to FIG. 3; for this purpose, the spindle body 32 has, at least at one of its two ends, a polygonal stub 34 which is inserted firmly in the associated wall 28. For rotatable mounting on the spindle body 32, the roller 30 has a hub 36 at each of its two ends. Between these two ends, the roller 30 has a cylindrical outer surface 38 which is coated with aluminum-oxide grains or has commercially available abrasive paper or abrasive coated cloth applied adhesively around it or is provided with a pronounced degree of roughness in some other manner.

The roller 30 is hollow and, in the region between its two hubs 36, encloses the spindle body 32 and a spring 40 with a radial interspace. The spring 40 is wound from steel wire in the manner of a helical spring and, according to FIG. 3, has an end section 42 comprising a plurality of spring coils which are wound around the spindle body 32 in a close-fitting manner such that they are normally connected to it in a frictionally locking manner and, on account of the fixed connection of the spindle body 32 to at least one of the walls 28, are thus assigned to the housing 10. That hub 36 of the roller 30 which is remote from said end section 42 has an axis-parallel hole 44. Adjoining the end section 42 which is formed, according to FIG. 3, by close-fitting spring coils, the spring 40 has a main part 46. The latter is formed by a comparatively large number of spring coils which, in the non-loaded state of the spring, surround the spindle body 32 with radial spacing. Finally, the spring 40, according to FIG. 3, has a straight, axis-parallel end section 48 which is inserted in the hole of the roller 30 and is thus assigned to the latter.

The paper-towel dispenser represented includes a severing device 50, on which it is possible to sever the paper web 24 which has been drawn off by a predetermined distance from the roll 22, through the slit 26 and around the roller 30. According to FIGS. 1 and 2, the severing device 50 is simply formed by a sharp-edged, toothed strip; however, the severing device 50 could also have a cutter which executes controlled cutting movements. In the example represented, the severing device 50 is formed directly on a hood-like, front housing part 52 which, together with the rear housing part 12, forms the housing 10, which is usually open only towards the bottom. The hood-like front housing part 52 is mounted on the hinge pins 18 such that it can be pivoted upwards to release the mount 20 for the insertion of a new paper roll 22.

It is only in comparison with FIG. 3 that the embodiment represented in FIG. 4 differs from the embodiment described hitherto. In contrast to FIG. 3, the spindle body 32 is mounted at each of its two ends, of which only one is represented in FIG. 4, in one of the two lateral walls 28 in a rotatable manner, but, in contrast, is firmly connected to the roller 30 for joint rotation. For this purpose, at least one polygonal stud 34 is once again formed on the spindle body 32, but is fastened in a hub 36 of the roller 30, said hub being formed in a region of the roller which is located further towards the inside in the axial direction as compared with FIG. 3.

Instead of the roller 30, according to FIG. 4 it is the left-hand wall 28, shown in said Figure, of the housing 10 which has an axis-parallel hole 44, and the axis-parallel end section 42 of the spring 40 is inserted in said hole, with the result that said end section 42 is once again assigned—directly—to the housing 10. The opposite end section 48 is once again assigned to the roller 30. Here, however, said end section 48, as is represented in FIG. 4, is formed by a number of spring coils which are wound around the spindle body 32 in a close-fitting manner, with the result that they form a directional lock with said spindle body—that is to say also with the roller 30.

There are no fundamental differences in the main part 46 of the spring 40 according to FIG. 4 as compared with the spring 40 represented in FIG. 3; in principle, the spring 40 according to FIG. 4 is only arranged in reverse in comparison with FIG. 3, the functions of the end sections 42 and 48 having been interchanged. The right-hand half, not shown in FIG. 4, of the roller 30 and of the spindle body 32 is preferably symmetrical with respect to the left-hand half, and it is also possible to arrange a spring 40, symmetrically with respect to that represented in FIG. 4, within the right-hand half of the roller 30 if it is desired to increase the spring action.

The two embodiments represented in FIGS. 3 and 4 do not differ as far as effect is concerned. In both cases, the spring 40 is subjected to stressing when the roller 30 is rotated forwards by the paper web 24 drawn off to the right according to FIG. 2. After a number of, for example five, revolutions of the roller 30, all the coils of the main part 46 of the spring 40 rest against the spindle body 32, with the result that the roller 30 cannot be rotated any further forwards. Consequently, the paper web 24 becomes taut, with the result that it can be torn off at the severing device 50. The part of the paper web 24 which remains attached to the roll 22 moves down and releases the roller 30, with the result that the latter is rotated backwards by the spring 40 until the stored spring energy is dissipated. Thereafter, the roller 30 which is accelerated in the direction of backwards rotation tries to overtake the spring 40. However, it rotates some way, but together with the spring 40 (FIG. 3) or the roller 30 can be rotated freely together with the spindle body 32 (FIG. 4) because the directional lock formed by the close-fitting spring coils permits a relative rotation in the direction of backwards rotation.

We claim:

1. Paper-towel dispenser having a housing (10) which has a mount (20) for a roll (22) of paper, a roller (30) which is mounted on the housing (10) by means of a spindle body (32) and can be rotated forwards by a predetermined angle, with the result that a paper web (24) of predetermined length can be drawn off the roll (22) via the roller (30), a severing device (50) by means of which the drawn-off paper length can be severed from the paper web (24), and a spring (40) which has an end section (42) assigned to the housing (10) and an end section (48) assigned to the roller (30), with the result that, in the event of forwards rotation of the roller (30), said spring is subjected to stressing and rotates said roller into a rest position after the paper web (24) has been severed, characterized in that the spring (40) is wound in the form of a coil around the spindle body (32), one of the end sections (42, 48) is formed by spring coils which always rest against the spindle body (32) in a close-fitting manner, with the result that they act as a directional lock, and between its end sections (42, 48), the spring (40) has a main part (46) comprising spring coils which, in the non-stressed state, enclose the spindle body (32) with radial spacing, only rest against the spindle body (32) in a close-fitting manner after the predetermined forwards rotation of the roller (30), and consequently prevent further rotation of the roller (30).

2. Paper-towel dispenser according to claim 1, characterized in that the roller (30) is hollow and encloses at least the main part (46) of the spring (40).

3. Paper-towel dispenser according to claim 1 or 2, characterized in that the spindle body (32) is fastened on the housing (10) in a non-rotatable manner, the roller (30) is mounted on the spindle body (32) in a rotatable manner, the end section (48), assigned to the roller (30), of the spring (40) is fastened directly on the roller (30), and the end section (42), assigned to the housing (10), of the spring (40) is formed by the close-fitting spring coils.

4. Paper-towel dispenser according to claim 1 or 2, characterized in that the spindle body (32) is mounted on the housing (10) in a rotatable manner, the roller (30) is fastened on the spindle body (32), the end section (42), assigned to the housing (10), of the spring (40) is fastened directly on the housing (10), and the end section (48), assigned to the roller (30), of the spring (40) is formed by the close-fitting spring coils.

* * * * *